United States Patent [19]

Poirier

[11] Patent Number: 4,921,147

[45] Date of Patent: May 1, 1990

[54] POURING SPOUT

[76] Inventor: Michel Poirier, 1300 Beauregard Street, Longueuil, Canada, J4K 4Z2

[21] Appl. No.: 306,405

[22] Filed: Feb. 6, 1989

[51] Int. Cl.[5] ..... B65D 5/74

[52] U.S. Cl. ..... 222/527; 222/568; 220/855 P; 141/33 T; 138/121

[58] Field of Search ..... 222/107, 215, 527, 528, 222/568; 220/8, 287, 855 P; 141/337; 138/121

[56] References Cited

U.S. PATENT DOCUMENTS

| | | | |
|---|---|---|---|
| 2,387,011 | 10/1945 | Czerner . | |
| 2,516,728 | 7/1950 | Smith . | |
| 2,597,593 | 5/1952 | Neuner . | |
| 2,630,247 | 3/1953 | Rafferty . | |
| 3,298,577 | 11/1967 | Chlystun . | |
| 3,313,319 | 4/1967 | Osborn et al. | 138/121 |
| 3,582,536 | 6/1971 | Miller | 138/121 |
| 3,643,702 | 2/1972 | Kauder | 138/121 |
| 3,676,076 | 7/1972 | Grady . | |
| 3,826,409 | 7/1974 | Chilcoate . | |
| 3,908,704 | 9/1975 | Clement et al. | 138/121 |
| 3,929,165 | 12/1975 | Diebolt et al. | 138/121 |
| 4,073,413 | 2/1978 | Tabler et al. . | |
| 4,079,757 | 3/1978 | Fischer et al. | 138/121 |
| 4,082,827 | 4/1978 | Chlystun . | |
| 4,095,728 | 6/1978 | Chlystun . | |
| 4,153,172 | 5/1979 | Bialobrzeski | 220/855 P |
| 4,340,089 | 7/1982 | Von Arnim et al. | 138/121 |
| 4,401,241 | 8/1983 | Cruz | 222/527 |
| 4,426,027 | 1/1984 | Maynard, Jr. | 222/529 |
| 4,428,498 | 1/1984 | Obey . | |
| 4,492,324 | 8/1985 | Weber . | |
| 4,583,668 | 4/1986 | Maynard, Jr. | 220/855 P |
| 4,593,690 | 6/1986 | Sheriden et al. | 138/121 |
| 4,600,125 | 7/1986 | Maynard, Jr. | 220/287 |
| 4,602,728 | 7/1986 | Ha . | |
| 4,650,100 | 3/1987 | Echazabal, Jr. . | |
| 4,706,719 | 11/1987 | Eversdijk | 141/337 |
| 4,773,458 | 9/1988 | Touzani | 220/8 |
| 4,775,564 | 10/1988 | Shriver et al. | 222/107 |
| 4,789,017 | 12/1988 | Panasewicz et al. | 141/337 |
| 4,832,238 | 5/1989 | Taylor | 141/337 |

FOREIGN PATENT DOCUMENTS

| | | |
|---|---|---|
| 1426846 | 8/1922 | Canada . |
| 259375 | 3/1926 | Canada . |
| 387357 | 3/1940 | Canada . |
| 399766 | 10/1941 | Canada . |
| 455016 | 3/1949 | Canada . |
| 506734 | 10/1954 | Canada . |
| 946763 | 5/1974 | Canada . |
| 284408 | 9/1983 | Canada . |
| 1218945 | 3/1987 | Canada . |

*Primary Examiner*—Joseph J. Rolla
*Assistant Examiner*—Steven Reiss

[57] ABSTRACT

A spout for a jerrycan, characterized by its flexing and telescoping capabilities. The spout consists of a main accordion-like tubular section, with a connector at one end and a nozzle at the other end. The length of the spout can double relative to its retracted condition, wherein it can be forcibly telescopingly extended/retracted, yet will maintain its last chosen extended/retracted condition when the forcible action ceases. The spout main section can be also be flexed, yet will similarly maintain its last chosen flexed condition once this forcible action ceases.

14 Claims, 4 Drawing Sheets

POURING SPOUT

FIELD OF THE INVENTION

This invention relates to spouts for pouring liquids from a container to another container.

BACKGROUND OF THE INVENTION

When one uses a spout with a jerrycan holding gazoline for transferring the gasoline to a motor engine or the like, one occasionally faces problems when the gas inlet of the motor engine is difficult of access: it may be in a restricted space which does not facilitate engagement of the spout nozzle thereinto. Also, one needs a spout which will not break if submitted to bending forces associated with access to limited areas.

OBJECTS OF THE INVENTION

The prime goal of the present invention is to provide a spout which will facilitate the pouring of a liquid from a container into another.

An important object of the invention is that the spout of the invention be extensible/retractable under forcible action thereon, yet will be able to maintain its last chosen shape once the forcible action ceases.

Another important object of the invention is that the spout of the invention be flexible under a forcible action thereon, yet will maintain its last chosen shape once the forcible action ceases.

An object of the invention is to provide such a spout which will be long lasting yet of economical make.

SUMMARY OF THE INVENTION

In accordance with the objects of the invention, there is disclosed a spout to pour a liquid from and through a liquid outlet toward and into an inlet, consisting of a main elongated tubular section, a connector member fixed at one end of said tubular section and releasably secured to said outlet, and a nozzle at the other end of said main section and adapted to freely engage said inlet; said tubular section forming bellows defining a plurality of interconnected first ribs, and being made from a semi-rigid material; further including first means whereby said tubular section will be flexible transversely to its longitudinal axis upon a first forcible action being applied thereon, yet will maintain its last chosen flexed condition when said first forcible action ceases, and second means whereby said tubular section is telescopingly extendable or retractable about its longitudinal axis upon a second forcible action being applied thereon, yet will maintain its last chosen extended or retracted condition when said second forcible action ceases.

Preferably, each rib is circular and consists of a pair of radially inwardly diverging frusto-conical walls which are interconnected at their larger diameter ends by a rounded section and by an offset section; each wall increasing in thickness from their larger diameter end to their smaller diameter end; a smaller diameter joint being defined between two adjacent ribs and being provided with a weakening groove at its outer surface; the wall which merges with said offset section being less inclined than the other wall relative to the longitudinal axis of the spout when the latter is straight.

Advantageously, said tubular section, said connector, and said nozzle are integrally molded from a single moldable material, preferably a thermo-plastic material, more preferably polyethylene, still more preferably being further admixed with between 10 and 35% (and most preferably by about 15%) by weight of polypropylene.

It is envisioned that, lengthwisely, each rib of said spout should have only two stable conditions, namely, a fully-retracted condition and a fully-extended condition, since the shape and resiliency of said ribs will bias said tubular section from any other intermediate conditions in the nearest retracted or extended condition.

Profitably, there are at least five consecutive ribs, and wherein the flexibility of said spout tubular section is such that said spout can be flexed by 90°, from a first position in which said connector member and nozzle are coaxial, to a second position in which said connector member and nozzle are at right angle to each other.

Advantageously, there are at least ten consecutive ribs, and wherein the flexibility of said spout tubular section is such that said spout can be flexed by 180°, from a first position in which said connector member and nozzle are coaxial, to a second position in which said connector member and nozzle are sidewisely parallel.

It would be desirable that said rounded section merge with one of said walls and with the larger diameter end of said offset section; said offset section being cross-sectionally straight and making a first angle with said other of said walls; whereby in the extended position of a rib, said pair of walls make an acute angle $\alpha$ and $\beta$, respectively with the longitudinal axis of the straightened spout, while in the retracted position of a rib, said angles $\alpha$ and $\delta$ remain substantially the same, however said one wall having snapped into a reversely inclined position defined by an obtuse angle Y.

DETAILED DESCRIPTION OF THE INVENTION

Figure 1:
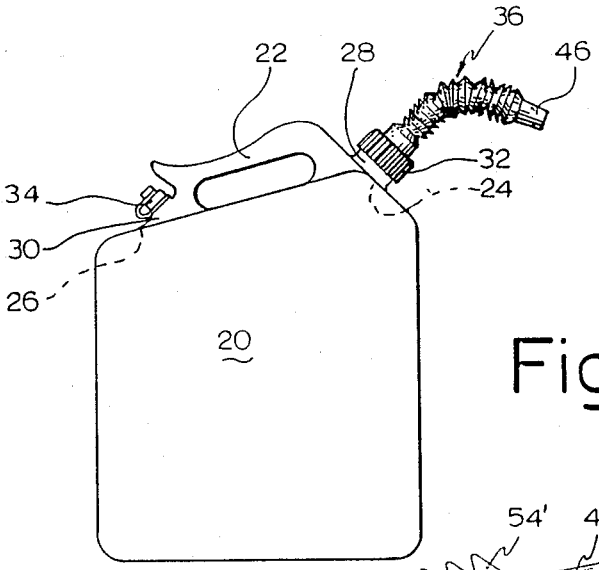
FIG. 1 is a side elevational view of a jerrycan, provided with a flexible spout made in accordance with the teachings of the invention.
Figure 2:
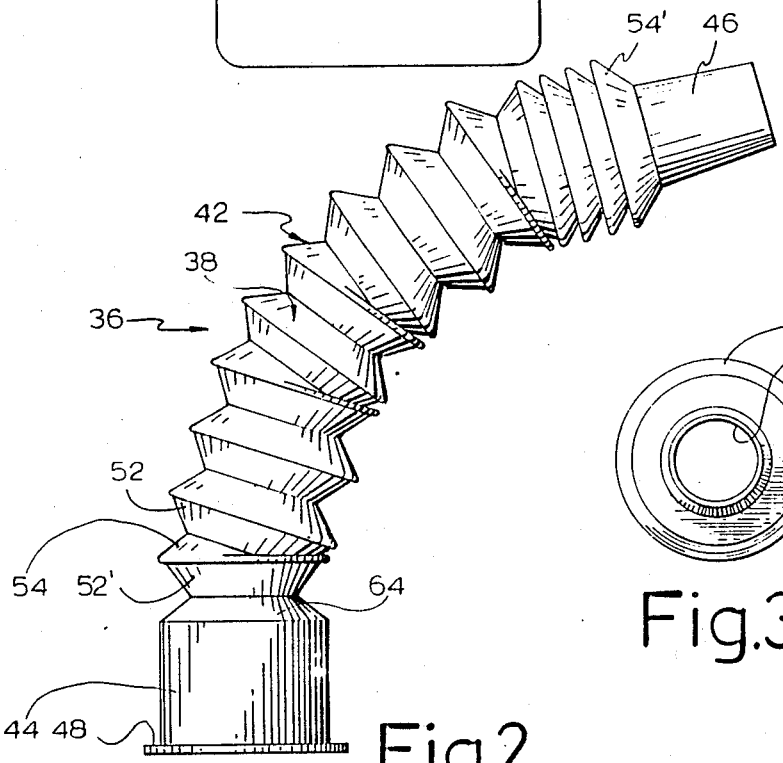
FIG. 2 is an enlarged elevational view of the spout of FIG. 1, in curved condition.
Figure 3:
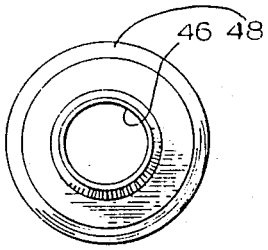
FIG. 3 is an enlarged end view of the outer end nozzle of said spout, taken from perspective 3—3 of FIG. 4.
Figure 4:
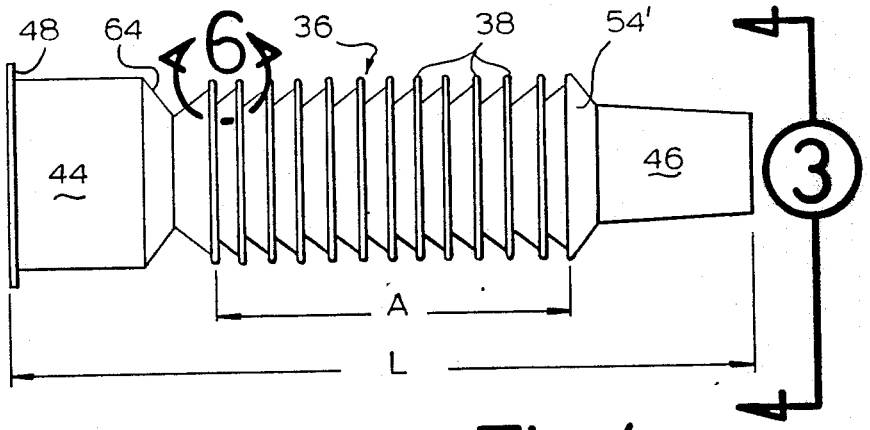
FIGS. 4–5 are semi schematic plan views of said spout, which is in straight condition, sequentially showing how it can be telescopingly extended, the spout of FIG. 5 being illustrated as partly broken.
Figure 5:
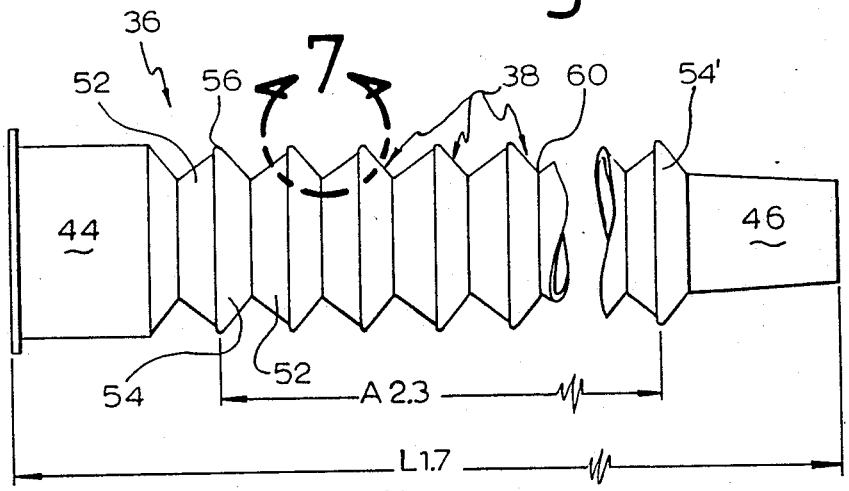

Jerrycan 20 is of conventional make, being destined to carry a liquid substance such as gasoline. Jerrycan 20 includes a top handle 22, a main outlet 24 forwardly of handle 22, and a small outlet 26 rearwardly of handle 22. The gazoline stored in jerrycan 20 is released by tilting it forwardly, so the gazoline escapes through main outlet 24. Small outlet 26 facilitates the flow of gazoline through the main outlet 24, since it enables ambient air to enter into the jerrycan through the conventional check valve of its closure cap 34, to compensate for the pressure gradient developed by the reduction of volume of gazoline occupied in the jerrycan. Outlets 24, 26 both define short circular sleeves 28, 30 projecting outwardly transversely of the main body 20 of the jerrycan. Sleeves 28, 30 are externally threaded, to receive a screwable collar 32 and screwable closure cap 34 respectively. Collar 32 secures a spout 36 in continuation with outlet 24.

Spout member 36 has two important features:

(1) it includes bellows means 38 in the form of circular ribs which telescopingly extend/retract it, advantageously by at least a 2 to 1 ratio, and will remain so extended or retracted;

(2) each rib 38 can be flexed transversely to the longitudinal axis of the elongated tubular spout, and will remain so flexed.

More specifically, ribs 38 are such that, upon a forcible action being applied to the spout, they allow the spout to occupy a variety of stable conditions, namely, fully or partially extended or retracted, and/or straightened or adjustably flexed, i.e. that they will maintain their last chosen flexed or extended/retracted condition once the forcible action ceases.

In addition, the spout flexibility provides a greater resistance to wear, since it will yield under strain rather than break. Only five consecutive ribs 38 are required to be flexed to provide a 90° angle between the two end sections of spout 36.

Spout member 36 is of integral make, i.e. is made from a single piece of thermoplastic material. Its above-noted characteristics come from both its rib shape and the type of material used for its manufacture.

Spout member 36 consists of a main accordion-like tubular section 42 formed by a series of ribs 38 and provided with two integral sleeve sections 44, 46 at its ends. Inlet sleeve 44 is cylindrical, and includes an annular outturned flange 48 at its outer end. Annular flange 48 is designed to conventionally flatly abut against the free edge of the jerrycan outlet sleeve 28. Collar 32, which has an outer inturned flange and an internal thread, conventionally takes in sandwich with sleeve 28 the spout flange 48 to frictionally immobilize the spout in operative position. In inoperative position, the spout 36 extends into can 20 with the inside face of flange 48 seating against sleeve 28. A closure disc (not shown) is inserted into collar 32 against its inturned flange and the collar 32 screwed onto sleeve 28 and over flange 48 to sealingly close the jerrycan.

Outlet sleeve section 46 is diametrally smaller than inlet sleeve section 44 and defines a slightly outwardly conical body.

Figure 7:
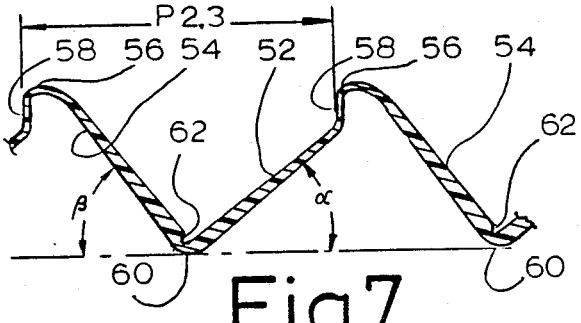
FIGS. 6–7 are enlarged cross-sectional views taken within areas 6 of FIG. 4 and 7 of FIG. 5, respectively.
Figure 6:
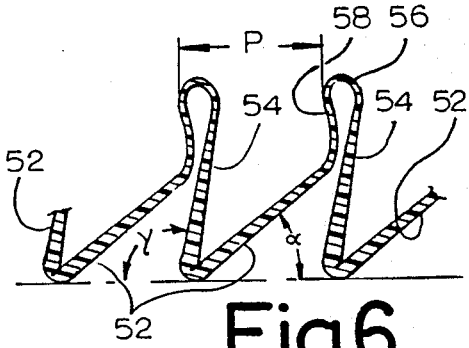

Each rib 38 is circular and consists of a pair of radially inwardly diverging frusto-conical walls 52 and 54 which are joined together at their larger diameter ends by a rounded section 56 and by an offset section 58 (FIGS. 6–7). Walls 52 and 54 are cross-sectionally straight and progressively increase in thickness from their larger diameter end to their smaller diameter end. Rounded section 56 merges with wall 54 and with the larger diameter end of offset section 58. Offset section 58 is cross-sectionally straight and makes a first angle of about 45° with wall 52. Two adjacent ribs 38 are interconnected by a joint 60 at the smaller diameter ends of a wall 52 of one rib and of a wall 54 of the adjacent rib. Joint 60 is weakened by a groove 62 made in its external surface.

In the extended position of a rib 38 (FIG. 7), walls 52 and 54 make an angle $\alpha$ and $\beta$, respectively with the longitudinal axis of the straightened spout 36. In the retracted position of a rib 38 (FIG. 6), angle $\alpha$ and said first angle remain substantially the same, however wall 54 has snapped into a reversely inclined position defined by angle Y. Angle $\alpha$ must be smaller than angle $\beta$. Preferably, $\alpha=37.4°$ and $\beta=52.3°$. During axial retraction or extension movement, since the smaller diameter joint 60 does not contract, an increasing axial force must be exerted to move said joint 60 through the plane of the rounded section 56. Past this plane, wall 54 will snap into its retracted or exended position. Only wall 54 reverses its inclination, since angle $\alpha$ is less than angle $\beta$.

The retracted position of the rib is stable because rounded section 56 and offset section 58 form a joint which cannot exert any axial extension force and because wall 54 remains cross-sectionally straight due to its progressive thickness in the radially inward direction. Groove 62 sufficiently weakens joint 60 and therefore sufficiently decreases the axial extension force exerted by said joint.

As shown, the pitch P of two adjacent ribs 38 changes by a ratio of about 2.3 from retracted to extended position. As shown in FIG. 6, wall 52 nearly contacts wall 54 in retracted position. This is possible due to the provision of rounded section 56 and offset section 58. During flexing, wall 54 reverses its inclination as for the axial retracting movement but only through about half its annular surface, the other half annular surface remaining in extended position. The rib 38 remains flexed due to its above-noted characteristics.

An important feature of the invention is the composition of the material constituting the spout 36. Indeed, this material should provide flexibility and resiliency to the spout, for accordion-like extension/retraction and for flexion; and resistance, i.e. that it will be able to sustain a plurality of extensions/retractions and flexions before becoming worn out (i.e. puncturing). Therefore, spout 36 should be made from a plastic material, preferably from high density polyethylene, and most preferably further having between 10 and 35% and preferably about 15% by weight of polypropylene.

The accordion wall 54' most proximate to outlet nozzle 46 merges with the diametrally largest section of mouth 46. At the opposite end, it is a conical wall 52' which merges at its diametrally smallest section with a conical (rigid) extension 64 of sleeve 44.

Figure 9:
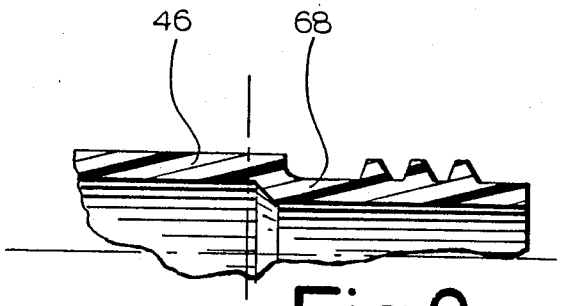
FIGS. 9–10 are sectional views taken within areas 9 and 10 respectively of FIG. 8.
Figure 10:
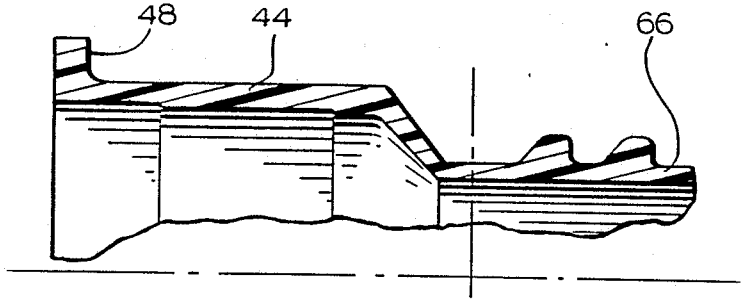
Figure 8:
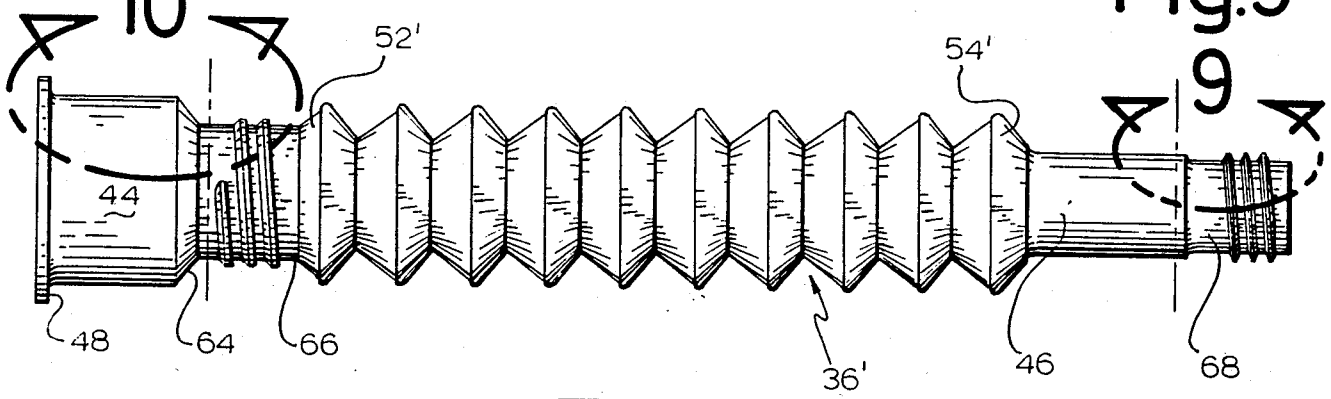
FIG. 8 shows a plan view of a second embodiment of spout in extended straight condition.

FIGS. 8–10 show an alternate embodiment of spout member, 36', in which conical walls 52' and 64 are spacedly interconnected by a threaded axial sleeve 66, and nozzle 46 is extended by a threaded axial sleeve 68. Section 68 is diametrally smaller than section 66, as shown. Section 68 is to receive a threaded closure cap while section 66 is to receive a cap for enclosing the spout in retracted position.

Figure 11:
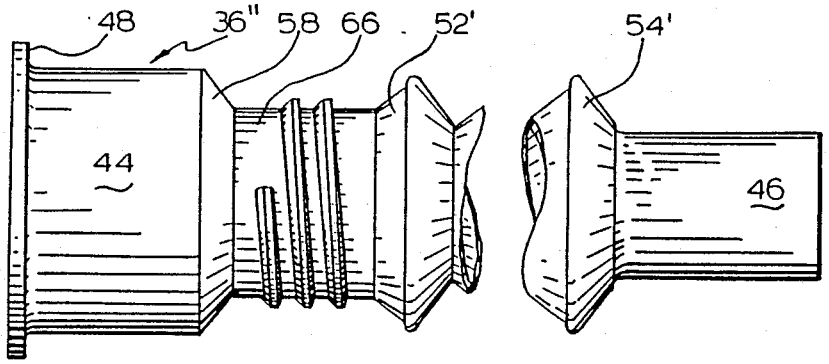
FIG. 11–12 are broken plan views of two other embodiments of spouts.

Spout 36'' in FIG. 11 is different from spout 36' in that it lacks section 68. Spout 36''' in FIG. 12 is different from spout 36' of FIG. 8 in that it lacks an inlet sleeve 44 and associated flange 48 and opposite cone section 64.

Figure 12:
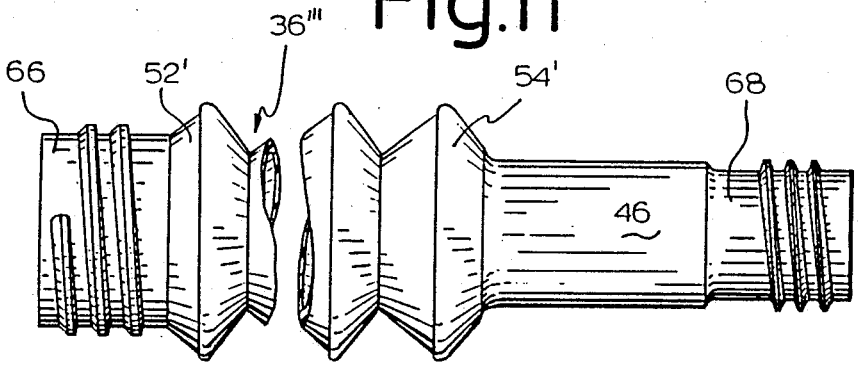
Figure 13:
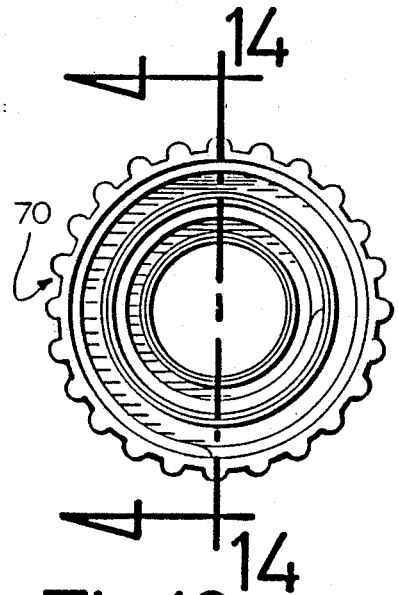
FIG. 13 is an end view of the inner end connector of the spout of FIG. 12.
Figure 14:
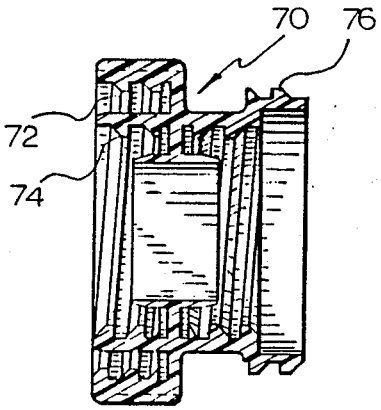
FIG. 14 is a cross-sectional view taken along line 14—14 of FIG. 13.

Connector 70 shown in FIGS. 13–14 has inner threads 72 to screw on the outlet sleeve 28 of can 20, inner threads 74 inwardly of threads 72 to receive threaded sleeve 66 of FIG. 12 and outer threads 76 on the opposite side of connector 70 relative to threads 70, 72 and which have the same purpose as threaded sleeve 66 of FIG. 8 or 11.

I claim:

1. A spout to pour a liquid from and through a liquid outlet toward and into an inlet, consisting of a main elongated tubular section, a connector member fixed at one end of said tubular section and releasably secured to said outlet, and a nozzle at the other end of said main section and adapted to freely engage said inlet; said tubular section forming bellows defining a plurality of interconnected first ribs, and being made from a semi-rigid material; further including first means whereby said tubular section will be flexible transversely to its longitudinal axis upon a first forcible action being applied thereon, yet will maintain its last chosen flexed condition when said first forcible action ceases, and second means whereby said tubular section is telescopingly extendable or retractable about its longitudinal axis upon a second forcible action being applied thereon, yet will maintain its last chosen extended or retracted condition when said second forcible action ceases; wherein each rib is circular and consists of a pair of radially inwardly diverging frusto-conical walls which are interconnected at their larger diameter ends by a rounded section and by an offset section; a smaller diameter joint being defined between two adjacent ribs and being provided with a weakening groove at its outer surface; the wall which merges with said offset section being less inclined than the other wall relative to the longitudinal axis of the spout when the latter is straight.

2. A spout as defined in claim 1, wherein said tubular section, said connector, and said nozzle are integrally molded from a single moldable material.

3. A spout as defined in claim 2, wherein said single moldable material is a thermo-plastic material.

4. A spout as defined in claim 3, wherein said plastic material is polyethylene.

5. A spout as defined in claim 4, wherein to said plastic material is further admixed between 10 and 35% by weight of polypropylene.

6. A spout as defined in claim 5, wherein about 15% by weight of polypropylene is admixed with said plastic material.

7. A spout as defined in claim 1, wherein said rounded section merges with one of said walls and with the larger diameter end of said offset section; said offset section being cross-sectionally straight and making a first angle with said other of said walls; whereby in the extended position of a rib, said pair of walls make an acute angle $\alpha$ and $\beta$, respectively with the longitudinal axis of the straightened spout, while in the retracted position of a rib, said first angle and angle $\alpha$ remain substantially the same, however said one wall having snapped into a reversely inclined position defined by an obtuse angle Y.

8. A spout as defined in claim 7, wherein angle $\alpha$ is smaller than angle $\beta$.

9. A spout as defined in claim 8, wherein said angle $\alpha$ equals about 37° and said angle $\beta$ equals about 52°.

10. A spout as defined in claim 7, wherein said first angle is about 45°.

11. A spout as defined in claim 1, wherein there are at least ten consecutive ribs, and wherein the flexibility of said spout tubular section is such that said spout can be flexed by 180°, from a first position in which said connector member and nozzle are coaxial, to a second position in which said connector member and nozzle are sidewisely parallel.

12. A spout as defined in claim 1, wherein lengthwisely, each rib of said spout has only two stable conditions, namely, a fully-retracted condition and a fully-extended condition, since the shape and resiliency of said ribs will bias said tubular section from any other intermediate conditions in the nearest retracted or extended condition.

13. A spout as defined in claim 1, wherein there are at least five consecutive ribs, and wherein the flexibility of said spout tubular section is such that said spout can be flexed by 90°, from a first position in which said connector member and nozzle are coaxial, to a second position in which said connector member and nozzle are at right angle to each other.

14. A spout as defined in claim 1, wherein each wall increases in thickness from their larger diameter end to their smaller diameter end.

* * * * *